US007954770B2

(12) United States Patent
Tomlinson, Jr. et al.

(10) Patent No.: US 7,954,770 B2
(45) Date of Patent: Jun. 7, 2011

(54) METHODS AND SYSTEM FOR JOINTLESS TRACK CIRCUITS USING PASSIVE SIGNALING

(75) Inventors: Harold Woodruff Tomlinson, Jr., Ballston Spa, NY (US); John Erik Hershey, Ballston Lake, NY (US); Jeffrey Michael Fries, Lee's Summit, MO (US)

(73) Assignee: General Electric Company, Schenectady, NY (US)

( * ) Notice: Subject to any disclaimer, the term of this patent is extended or adjusted under 35 U.S.C. 154(b) by 703 days.

(21) Appl. No.: 11/611,536

(22) Filed: Dec. 15, 2006

(65) Prior Publication Data

US 2008/0142645 A1 Jun. 19, 2008

(51) Int. Cl.
*B61L 25/00* (2006.01)

(52) U.S. Cl. ..... 246/122 R; 246/121

(58) Field of Classification Search ..... 246/122 R, 246/122 A, 34 R, 40, 34 B, 41, 54, 118, 120, 246/121, 220, 246, 255; 324/713, 718; 701/19; 238/14.12

See application file for complete search history.

(56) References Cited

U.S. PATENT DOCUMENTS 2,321,867 A * 6/1943 Smith ..... 238/14.12
3,868,075 A * 2/1975 Blazek et al. ..... 246/34 CT
4,932,614 A 6/1990 Birkin
5,330,135 A 7/1994 Roberts
5,470,034 A 11/1995 Reeves
5,680,054 A * 10/1997 Gauthier ..... 324/713
5,769,364 A * 6/1998 Cipollone ..... 246/34 B
7,268,565 B2 * 9/2007 Anderson ..... 324/713

FOREIGN PATENT DOCUMENTS

GB 2074768 11/1981
WO WO 2007/067708 6/2007

OTHER PUBLICATIONS

Union Switch & Signal, Service Manual 5865, "High Frequency Track Circuits: Installation and Maintenance", Dec. 1999.
"Jointless Track Circuit Length", by N. Nedelchev, from IEE Proc.-Electr. Power Appl., vol. 146, No. 1, Jan. 1999.
"Interference—Free Track Vacancy Detection", by K. Huemmer, Siemens AG, Federal Republic of Germany.
"Taking care of insulated joints: track maintenance has a direct impact on the electrical performance of insulated joints, so c & s and m/w must work closely together", by Michael House, from Railway Track and Structures, May 2005.

* cited by examiner

*Primary Examiner* — Mark T Le
(74) *Attorney, Agent, or Firm* — GE Global Patent Operation; John A. Kramer

(57) ABSTRACT

In a jointless track system, passive signaling devices ("PSDs") are coupled to a railroad track. The PSDs are used to optimize the amplitude, modulation, coding, and frequency of waveforms that are applied to the track (by signaling points) for at least three track circuit functions: detecting trains, detecting broken rails, and communicating between the signaling points and PSDs.

12 Claims, 7 Drawing Sheets

METHODS AND SYSTEM FOR JOINTLESS TRACK CIRCUITS USING PASSIVE SIGNALING

BACKGROUND

1. Field of the Invention

The present disclosure relates to railroads generally, and more particularly, to methods and systems for using passive signaling in jointless track circuits.

2. Discussion of Related Art

Conventional track circuits use signaling points to monitor a block of railroad track for the presence of trains and broken rails. Signals transmitted and/or received by the signaling points indicating the block state (e.g., whether occupied, empty, or containing a broken rail) are used to directly control the wayside signal aspects, and to send information to the train (via cab signals in the rail) or a central office (via remote communication links).

Blocks of railroad track are separated from each other by insulative joints (e.g., pieces of electrically insulative material), which are interposed between sections of rail. Use of jointed tracks, however, has several disadvantages. First, the pieces of electrically insulative material are expensive to install and maintain, and tend to deteriorate over time. Additionally, the distance between signaling points is limited because leakage current flows through the ballast (e.g., the material under and/or between the rails that forms or rests on the railroad bed), thereby attenuating an applied voltage between the rails. The attenuation typically occurs exponentially with distance from the source signaling point.

The current sensed at a receiving signal point is typically compared to a threshold value, and decisions about track occupancy, broken rails, and bits (e.g., codes, or signal aspects) are made based on this threshold. Since ballast leakage can vary with time and weather conditions, the threshold must be set to accommodate these changes while meeting the detection criteria for track occupancy (a short across the rails) and broken rails (an open break in a rail). A disadvantage is that this fixed threshold represents a joint optimization for detecting track occupancy, broken rails, and communication, but is typically not optimized for any one function.

Existing approaches to jointless track circuits, used for example, in passenger rail systems, apply audio frequencies (@1 kHz to @10 kHz) voltages to the railroad track. The voltages are confined to a section of track by tuned shunts placed across the track at the block boundaries. The problem with this type of jointless track circuit is that the signaling points can be located only about 0.5 miles apart due to the low-pass filtering effect of the rail inductance. This type of circuit is not practical for rail applications requiring block lengths longer than 0.5 miles.

A solution is needed that eliminates the insulated joints previously used to define a block of railroad track; that significantly extends the distance between signaling points; and that provides an inexpensive means for sensing track conditions. Additionally, to accommodate long distances between signaling points, it would be advantageous to place sensors along the track to help determine changes in the track model (e.g., to sense track conditions), or to act as communication repeaters. Such solutions will eliminate the maintenance costs and operational downtime associated with failed insulative joints.

BRIEF DESCRIPTION

The present disclosure describes new methods and systems for extending track circuits and eliminating insulated joints that meet the needs identified above and provide solutions to the problems left unsolved by prior approaches. In particular, passive signaling devices ("PSDs") are electrically connected to a railroad track. The PSDs are configured to place a programmable shunt impedance across the railroad track that can be used with voltages applied at the signaling points to aid in communication, train detection, and break detection for jointed and jointless track circuits. Signaling points can optimize the amplitude, modulation, coding, and frequency of waveforms that are applied to the railroad track (by signaling points) for at least three track circuit functions: detecting trains, detecting broken rails, and communicating between signaling points and PSDs. For example, train detection may require application of DC signals to detect a presence of train and AC signals to locate the position of the train. Alternatively, broken rail detection may require DC signals to detect breaks in the rails and AC signals to locate the position of the breaks. Additionally, communication of break detection and/or train detection data between PSDs and signaling points may require modulation techniques that have high spectral efficiency. Non-limiting examples of such modulation techniques include Pulse Amplitude Modulation ("PAM"), Quadrature Amplitude Moduation ("QAM"), Orthogonal Frequency Division Modulation ("OFDM"), and the like.

A new passive signaling device ("PSD") constructed according to the principles described in this disclosure has a unique operating sequence that can be used with signaling points to apply each of these different types of signals to the track in a duty cycle that is appropriate to the task. Thus, in some embodiments, train detection occurs frequently (meaning that the passive signaling device applies an AC signal to the track about once per second), whereas broken rail detection occurs less frequently (meaning that the passive signaling device applies a DC signal to the tracks about once per minute). In an embodiment, the PSD is a device placed between the track rails and powered through the rails by DC voltage supplied by a signaling point.

Each PSD may include a switch ("PSD switch"). When the PSD switch is closed, the PSD can sense current provided by the signaling point through the rails. When the switch is open, the PSD can sense voltage across the rails applied by the signaling point. The PSD can communicate with neighboring signaling points or PSDs using the switch to modulate the voltage or the current provided by the signaling point. This is analogous to a passive RFID tag, which receives its power through the RF interrogation waveform sent by a reader, and modulates the interrogation waveform to send information back to the reader. Using this approach, low cost voltage and current sensing PSDs can be installed along the track (without needing to lay extra cables) and powered by a signaling point located miles away. Use of PSDs configured as described herein improves the communication range of data because each PSD can communicate data to its neighbors, which can relay the data back to the signaling point. The signaling point can then relay the data to the cab of a train or to a control point at the railroad.

The PSD-based system and methods described herein leverage the fact that DC voltages (and low-frequency AC voltages) have the least attenuation in rails, and that an AC voltage/current can be generated on a rail by modulating the PSD switch when a signaling point applies a DC voltage to the rail. The AC voltage/current can be limited to a region on a rail by the rail inductance, and used to better resolve the location of rail breaks and the location of trains within a block of railroad track. More significantly, a PSD can be used to define a block boundary in place of an insulated joint.

In an embodiment, a method comprises a step of feeding a DC voltage from a signaling point to a railroad track. The method further comprises a step of recording an amount of current received by a passive signaling device ("PSD") that is electrically connected to the railroad track. The method further comprises a step of detecting a presence of one of a train and a break in the railroad track using the recorded amount of current received by the PSD.

In another embodiment, a method comprises a step of receiving a data packet from a passive signaling device ("PSD") that is electrically coupled to a railroad track. The method further comprises a step of processing a content of the data packet. The method further comprises a step of outputting as result of the processing an indication of one of NO BREAK, BREAK, NO TRAIN, and TRAIN.

In another embodiment, a jointless track system, comprises a railroad track including a first rail and a second rail. The jointless track system further comprises a signaling point electrically connected to the railroad track. The jointless track system further comprises a passive signaling device ("PSD") electrically connected to the railroad track at predetermined distance from the signaling point.

In another embodiment, a passive signaling device ("PSD") comprises a control device, and a current sensor coupled with the control device. The current sensor is configured to be coupled with a first rail of a railroad track. The PSD further includes a PSD switch coupled with the control device. The PSD switch is configured to couple with a second rail of the railroad track.

Other features and advantages of the disclosure will become apparent by reference to the following description taken in connection with the accompanying drawings.

BRIEF DESCRIPTION OF THE DRAWINGS

For a more complete understanding of the new passive signaling device ("PSD"), the system and methods for extending track circuits and eliminating insulated joints, and the advantages thereof, reference is now made to the following descriptions taken in conjunction with the accompanying drawings, in which.

Like reference characters designate identical or corresponding components throughout the several views.

DETAILED DESCRIPTION

Figure 1:
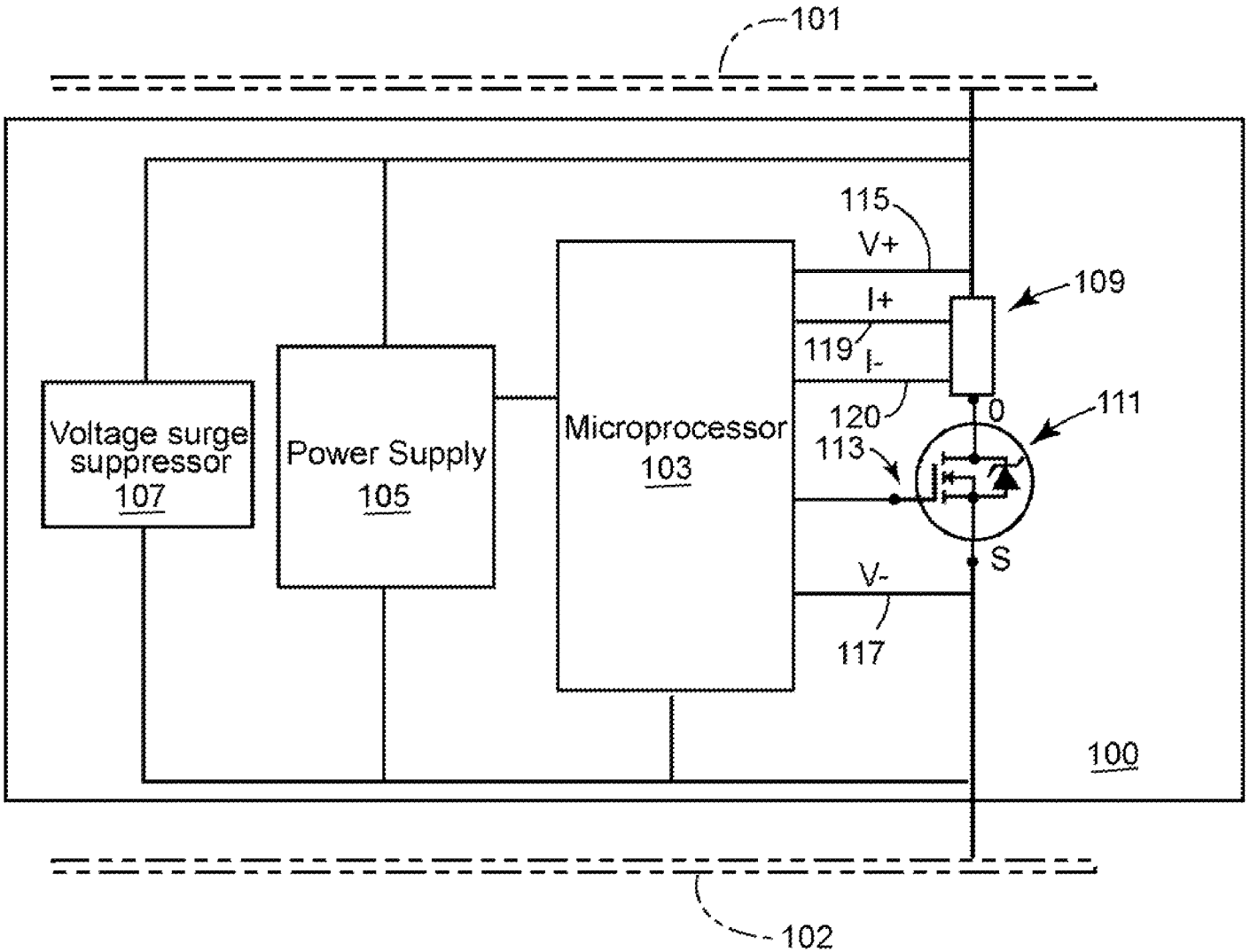
FIG. 1 is a diagram of a PSD that may be constructed in accordance with the principles set forth in this disclosure.

FIG. 1 is a diagram of a new passive signaling device ("PSD") 100 configured configured to detect a presence of a train or a presence of a broken rail within a predetermined section (e.g., block) of railroad track (hereinafter "track"). The PSD 100 may also be configured to communicate track data to a signaling point. Track data includes, but is not limited to: data indicating a train is present within a predetermined block of track; data indicating a train is not present within the predetermined block of track; data indicating a train is approaching or receding from a PSD; data indicating a rail (or rails) within the predetermined block of track has a break; and data indicating there are no breaks with the rail (or rails) within the predetermined block of track.

Referring to FIG. 1, a PSD may include a low-power control device 103, a power supply 105, a voltage surge protector 107, a current sensor 109, and a PSD switch 111. The control device 103 may be any suitable type of device configured to operate the new PSD. Non-limiting examples of a control device 103 include: a microprocessor, a microcontroller, a programmable logic device, an oscillator (that periodically activates the PSD switch 111), and the like. The oscillator could be used, in an embodiment, to detect a break in "dark territory" over an extended length of railroad track.

In an embodiment, the PSD switch 111 is a power MOSFET, and the power supply 105 is a DC-DC converter. Alternatively, the power supply 105 could operate from a rectified AC voltage supplied by a signaling point. The control device 103 may be configured to measure switch current and track voltage. Additionally, the control device 103 may comprise a processor, a memory, an analog-to-digital ("A/D") converter, and analog and digital outputs. A non-limiting example of a suitable control device is one selected from the MSP430 family of ultra-low power microcontrollers manufactured by Texas Instruments of Dallas, Tex.

Each of the power supply 105, the voltage surge protector 107, the current sensor 109, and the PSD switch 111 couple with the control device 103. The current sensor 109 connects to the PSD switch 111. The current sensor 109 is configured to electrically connect to the rail 101 of a railroad track; and the PSD switch 111 is configured to electrically connect to another rail 102 of the same railroad track. In this manner, the PSD 100 is positioned between the rails 101, 102, and may be buried in the ballast between them. Any suitable fastening means may be used to electrically connect the current sensor to the rail 101 and to electrically connect the PSD switch 111 to the rail 102, as long as no complete breaks are made in either the rail 101 or the rail 102. In an embodiment, a complete break is any type of gap that severs a rail 101 or 102 into two separate, electrically insulated pieces. Optionally, the electrical connections could be made through a low-pass filter to reject high frequency voltages that may be on the track from grade crossings or other track systems.

Additionally, a V+ lead 115 may couple the control device 103 with the rail 101, and a V− lead 117 may couple the control device 103 to the second rail 102 so the control device 103 can measure the voltage across the rails. Additionally, a positive current (I+) lead 119 and a negative current (I−) lead 120 may connect the current sensor 109 to the control device 103, so the control device 103 can measure the current through the PSD switch 111.

In operation, V+ and V− provide inputs to an analog to digital (A/D) converter operated by the control device 103, which processes the converted V+, V− inputs to monitor track voltage when the PSD switch 111 is open (e.g., off). Similarly, I+ and I− provide inputs to the analog to an digital (A/D) converter (not shown) operated by the control device 103, which processes the converted I+, I− inputs to monitor track voltage when the PSD switch 111 is closed (e.g., on). The DC-DC boost converter steps up voltage that a distant signaling point sends through the rails 101,102. The stepped-up voltage is used to operate the control device 103. The voltage surge protector 107 protects the PSD 100 and its components from harmful electrical surges (caused by lightning strikes or other phenomena).

The PSD 100 may further include a memory (not shown) coupled with the control device 103. Computer-readable instructions may be stored within the memory that when processed by the control device 103 cause the control device 103 to perform one or more of the method steps described herein.

In an embodiment, an on-resistance of the PSD switch 111 is between about 0.005 Ohms and about 0.020 Ohms, which is lower than the maximum shunt resistance specification of the train, so the total PSD switch resistance may be limited by quality of the connection to the rails. Current consumption to drive the PSD switch at about 5 kHz is estimated to be about 0.5 mA, of which about 0.2 mA is needed for the control device 103. Total power consumption in one embodiment is about 1 mA×3.3 v=3 mW, which can easily supplied from DC voltage on the rail provided by a signaling point.

Persons of ordinary skill in railroad signaling will appreciate that the exemplary configuration of the PSD 100 of FIG. 1 assumes that voltage signaling on the rail is unipolar. Consequently, other configurations of the PSD 100 may be required for other types of voltage signaling.

Figure 2:
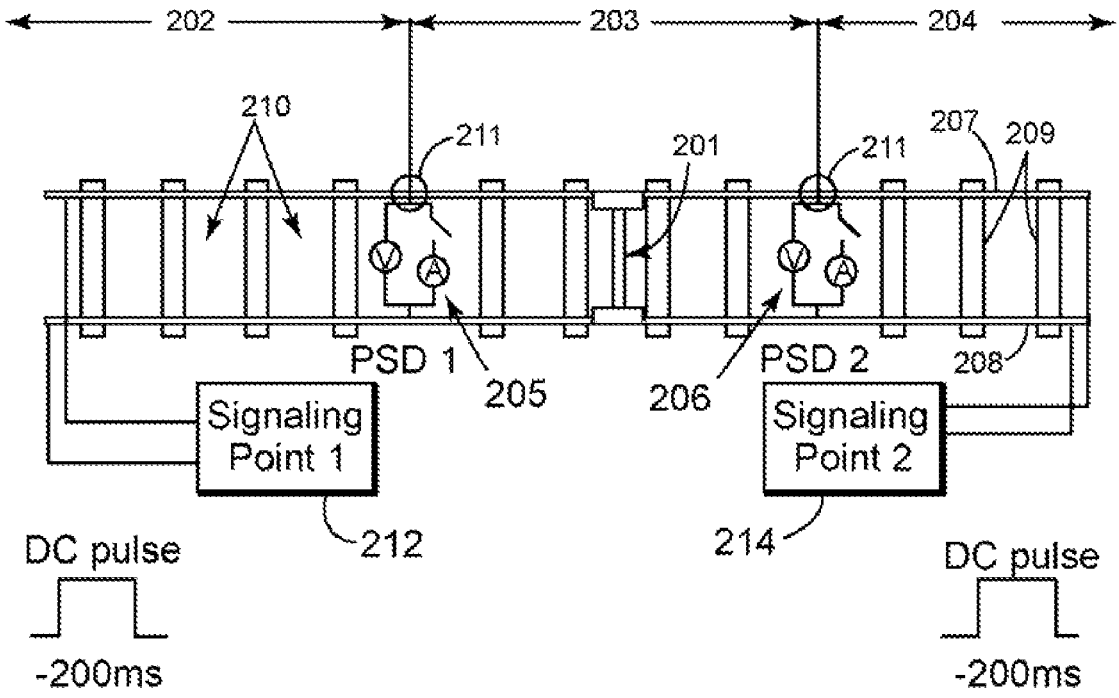
FIG. 2 is a system diagram illustrating how the PSD of FIG. 1 may be configured and used to detect a train along a predetermined section of railroad track.
Figure 4:
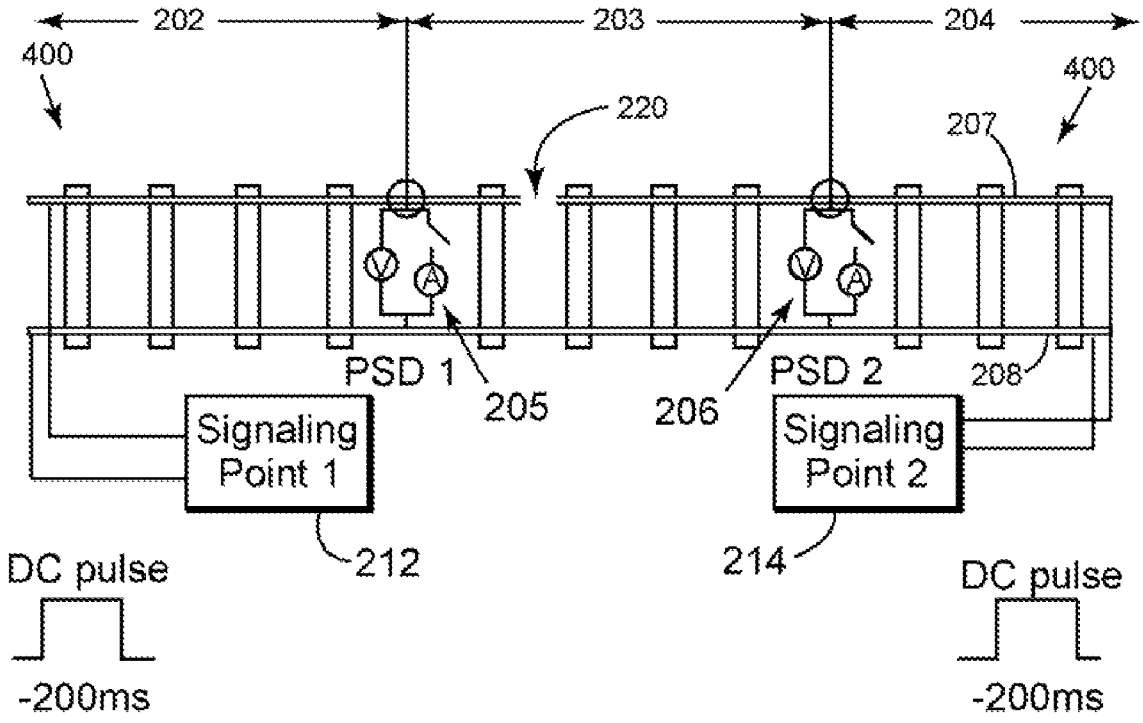
FIG. 4 is a system diagram illustrating how the PSD of FIG. 1 may be configured and used to detect a broken rail along a predetermined section of railroad track.
Figure 6:
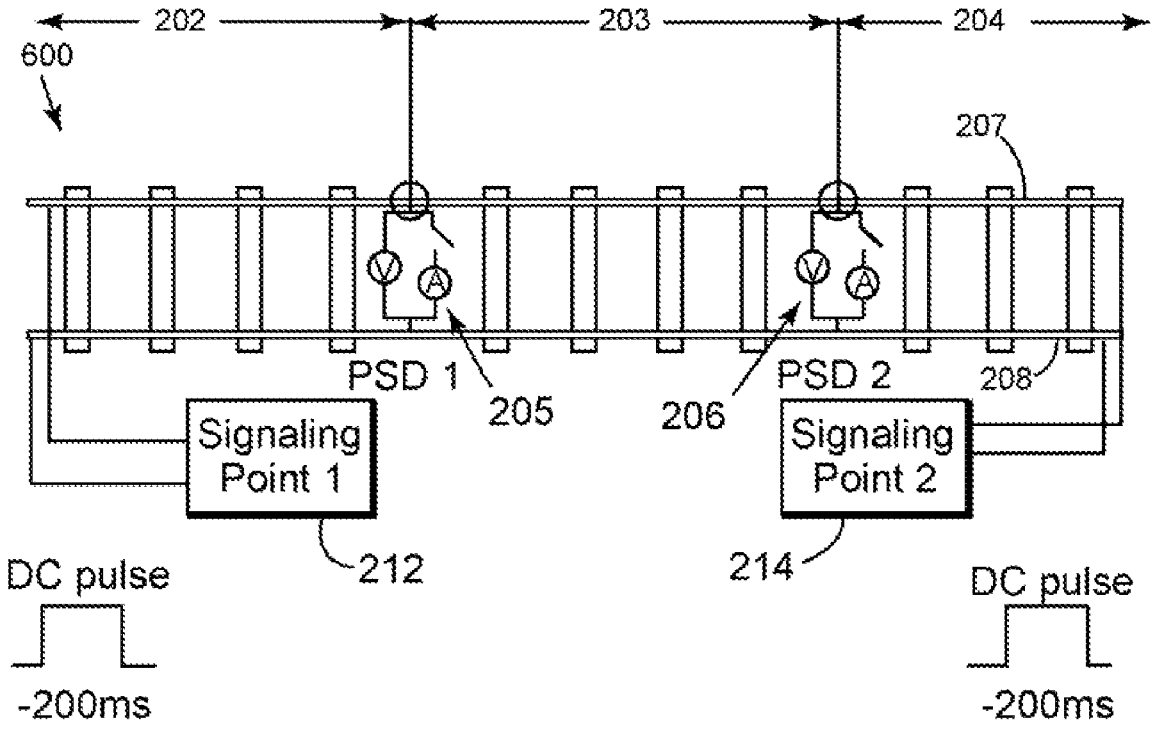
FIG. 6 is a system diagram illustrating how the PSD of FIG. 1 may be configured and used to communicate data to and from a signaling point.

FIG. 2 is a diagram 200 illustrating how the PSD 100 of FIG. 1 may be configured as part of a system and used to detect a presence of a train 201 (represented, for simplicity's sake, by a single axle and set of wheels) within a block of railroad track 203 that is defined between a first PSD 205 and a second PSD 206. Additional blocks of railroad track 202, 204 are formed to the left/right of the block of railroad track 203, respectively. It should be noted that FIGS. 2, 4, and 6 are not drawn to scale, and that the blocks of railroad track 202, 203, 204 may be any suitable length, but are preferably one or more miles long. Additionally, it should be noted that the PSDs 205, 206 are configured in the same (or like) manner as the PSD 100 of FIG. 1.

Each block of railroad track 202, 203, 204 includes two spaced-apart parallel rails 207, 208. The metal rails 207, 208 rest on a plurality of spaced apart railroad ties 209, each of which is positioned orthogonal to the rails 207, 208. Ballast 210, such as gravel, occupies the spaces between the rails 207, 208 that are bounded on either side by the railroad ties 209. The blocks of railroad track 202, 203, 204 may be formed between pairs of connections 211 that electrically connect the PSDs 205,206 to the rails 207,208.

A first signaling point 212 for communicating with the PSD 205 connects to each of the rails 207, 208. A second signaling point 214 for communicating with the PSD 206 connects to each of the rails 207, 208. In an embodiment, the PSDs 205, 206 are positioned between the points where the first signaling point 212 electrically connects to the rails 207, 208 and the points where the second signaling point 214 electrically connects to the rails 207, 208. In use, the first signaling point 212 and the second signaling point 214 each provide current and voltage to the rails 207, 208. The signaling point current and voltage are received and/or analyzed by the first PSD 205 and/or the second PSD 206, as further described below. As shown in FIG. 2, a voltage pulse of about 200 ms duration may be applied. In other embodiments, different frequencies and different types of waveforms may be used.

Figure 3:
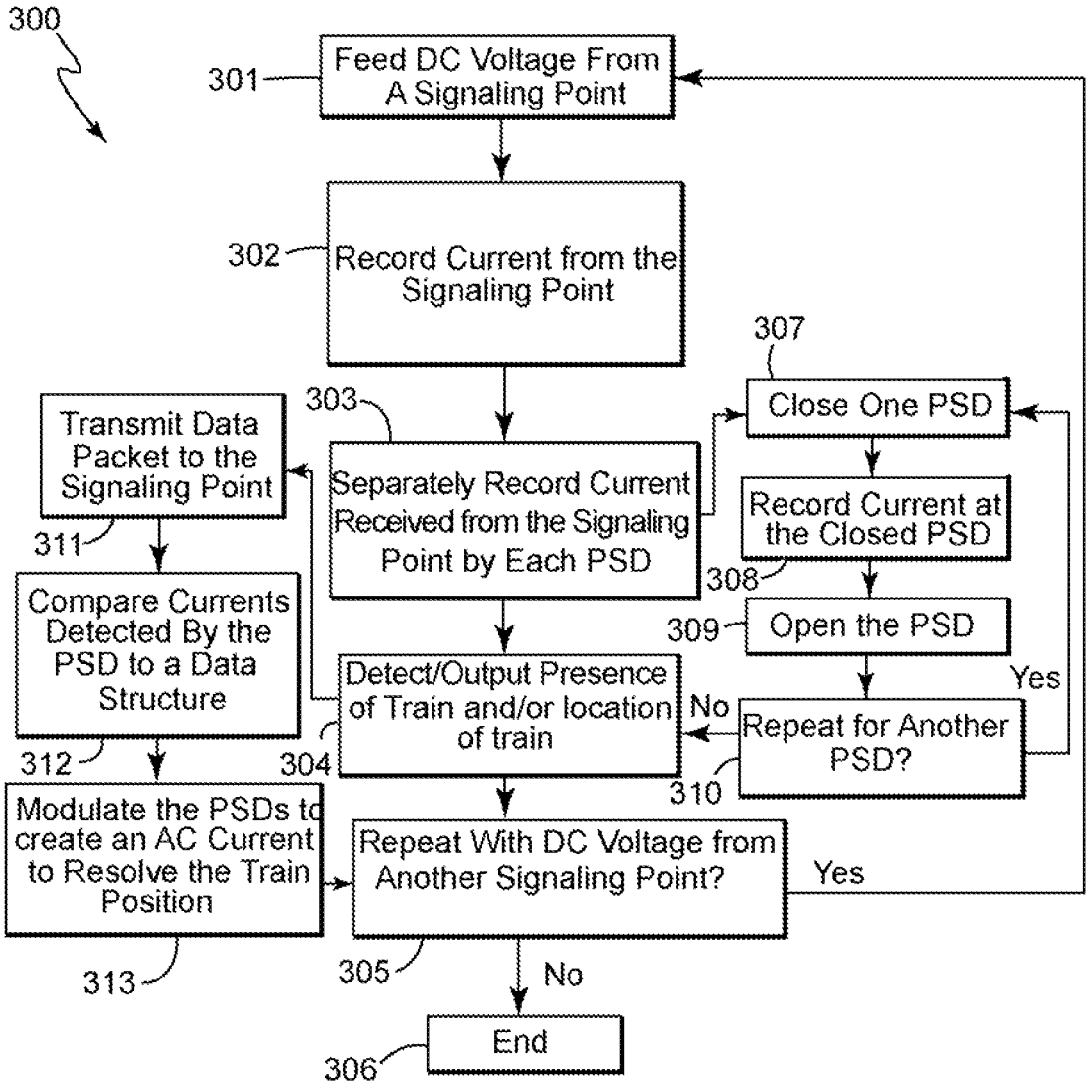
FIG. 3 is a flowchart illustrating an exemplary method of detecting a train along a predetermined section of railroad track.

FIG. 3 is a flowchart of an exemplary method 300 for detecting a train 201 within a block of railroad track 203, and is now described with respect to Table 1. Table 1 is an example of a data structure that may be used to detect a presence of a train 201 within a block of railroad track 203 by comparing currents detected by a first PSD 205 and a second PSD 206 with predetermined combinations of current that represent different situations such as: No-Train, Train between a first signaling point ("SP112") and PSD 205, and Train between PSD 205 and PSD 206.

TABLE 1

| Train Detection Currents | | | |
|---|---|---|---|
| | Current @ SP112 | Current @ PSD 205 | Current @ PSD 206 |
| No-Train | LOW | HIGH | HIGH |
| Train @ SP 1-PSD 1 | HIGH | LOW | LOW |
| Train @ PSD 1-PSD 2 | HIGH | HIGH | LOW |

Referring to FIGS. 2 and 3, the method 300 may begin at step 301 by feeding a DC voltage from the first signaling point 212. At step 302, the current from the first signaling point 212 is recorded. At step 303, the current received from the first signaling point 212 by each PSD 205, 206 is recorded. The step 303 may include steps 307, 308, 309, and 310. At step 307, one PSD within a block (illustratively PSD 205 in FIG. 2) is closed. At step 308, the current at the closed PSD is recorded. Then, at step 309, the PSD is opened. At step 310, this process may be repeated for the other PSD within range of the same signaling point (e.g., PSD 206 in FIG. 2). Thereafter, the method 300 may proceed to the step 304 of detecting/outputting a presence of a train. Step 304 may include steps 311, 312, and 313. At step 311, a data packet may be transmitted from both of the PSDs 205, 206 to the signaling point 212 or 214. In an embodiment, the data packet transmitted by the PSD 205 contains the amount of current recorded when the PSD 205 was closed; and the data packet transmitted by the PSD 206 includes the amount of current recorded when the PSD 206 was closed. At step 312, the currents detected and recorded at each of the closed PSDs 205, 206 are received the by signaling point 212. A recorded current that exceeds a predetermined threshold is classified as "High." A recorded current that meets or falls below the pre-determined threshold is classified as "Low." After being received by the signaling point 212, the recorded currents are compared to a data structure of the type shown in Table 1 to determine a train's presence within a block of railroad track (e.g., the position of the train 201 within bock 203 in FIG. 2). If a train is detected, then at step 313, either or both of the PSDs 205, 206 may be modulated at a predetermined frequency (or frequencies) to create an AC current to resolve the train's position within the block of track. Since a train approaching a PSD 205 or 206 creates an electrical short across the tracks, which changes the impedance (and thus the amount of current that flows through the rails 205, 206), the changes in impedance/current may be used in an embodiment of step 313 to calculate the distance the train is from either PSD 205 or PSD 206.

FIG. 4 is a diagram 400 illustrating how the PSD 100 of FIG. 1 may be configured as part of a system and used to detect a broken rail 207 along a block of railroad track 203. As shown, in FIG. 4, the rail 207 has a complete break 220 therethrough. The elements 202, 203, 204, 205, 206, 207, 208, 212, and 214 that comprise the diagram 400 are the same as those shown in FIG. 2, and for brevity's sake their descriptions are not repeated.

Figure 5:
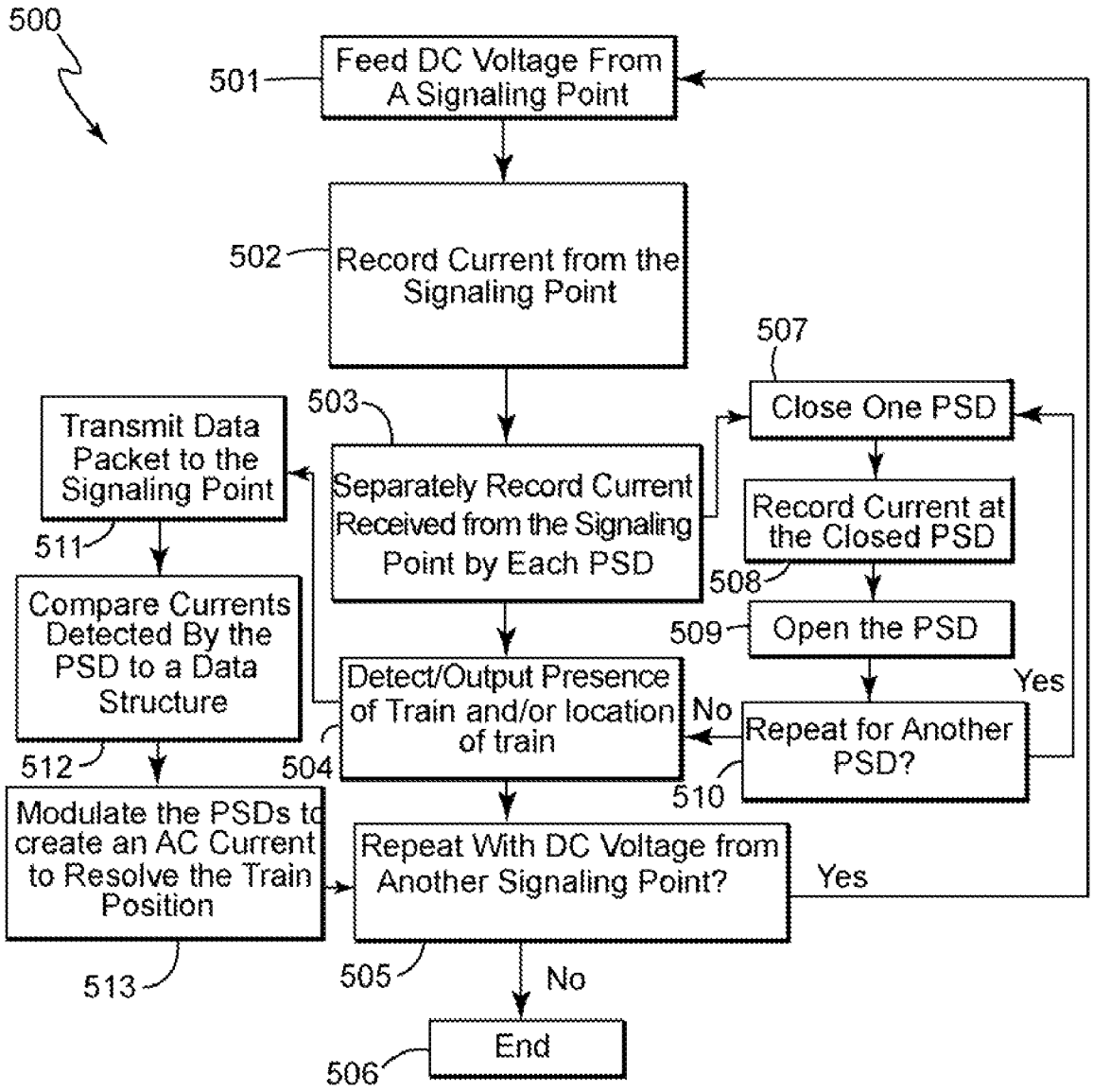
FIG. 5 is a flowchart of an exemplary method for detecting a broken rail along a predetermined section of railroad track.

FIG. 5 is a flowchart of an exemplary method 500 for detecting a break 220 within a block of railroad track 203, and is now described with respect to Table 2. Table 2 is an example of a data structure that may be used to detect a presence of a break within a block of railroad track 203 by comparing currents detected by a first PSD 205 and a second PSD 206 with predetermined combinations of current that represent different situations such as: No Break, Break between a first signaling point ("SP112") and PSD 205, and Break between PSD 205 and PSD 206.

TABLE 2

| Break Detection Currents | | | |
|---|---|---|---|
| | Current @ SP112 | Current @ PSD 205 | Current @ PSD 206 |
| No-Break | LOW | HIGH | HIGH |
| Break @ SP 1-PSD 1 | LOW | LOW | LOW |
| Break @ PSD 1-PSD 2 | LOW | HIGH | LOW |

Referring to FIGS. 4 and 5, the method 500 may begin at step 501 by feeding a DC voltage from a first signaling point 212. At step 502, the current from the first signaling point 212 is recorded. At step 503, the current received from the first signaling point 212 by each PSD 205, 206 is recorded. The step 503 may include steps 507, 508, 509, and 510. At step 507, one PSD within a block (illustratively PSD 205 in FIG. 2) is closed. At step 508, the current at the closed PSD is recorded. Then, at step 509, the PSD is opened. At step 510, this process may be repeated for the other PSD within range of the same signaling point (e.g., PSD 206 in FIG. 2).

Thereafter, the method 500 may proceed to the step 504 of detecting/outputting a presence of a break in either or both of the rails 207, 208. Step 504 may include steps 511, 512, and 513. At step 511, a data packet may be transmitted from both of the PSDs 205, 206 to the signaling point 212 or 214. In an embodiment, the data packet transmitted by the PSD 205 contains the amount of current recorded when the PSD 205 was closed; and the data packet transmitted by the PSD 206 includes the amount of current recorded when the PSD 206 was closed. At step 512, the currents detected and recorded at each of the closed PSDs 205, 206 are received the by signaling point 212. A recorded current that exceeds a predetermined threshold is classified as "High." A recorded current that meets or falls below the predetermined threshold is classified as "Low." After being received by the signaling point 212, the recorded currents are compared to a data structure of the type shown in Table 1 to determine a break's presence within a block of railroad track (e.g., the position of the break 220 within bock 203 in FIG. 4). At step 513, either or both of the PSDs 205, 206 may be modulated at a predetermined frequency (or frequencies) to create an AC current to resolve the break's position within the block of track. Thereafter, the method 500 may end.

FIG. 6 is a diagram 600 illustrating how the PSD 205 (which corresponds to the PSD 100 of FIG. 1) may be configured as part of a system and used to communicate data to and from signaling points 212, 214, which are not in direct communication with each other due to signal loss along the track. The elements 202, 203, 204, 205, 206, 207, 208, 212, and 214 that comprise the diagram 600 are the same as those shown in FIGS. 2 and 4. For brevity's sake, their descriptions are not repeated.

Figure 7:
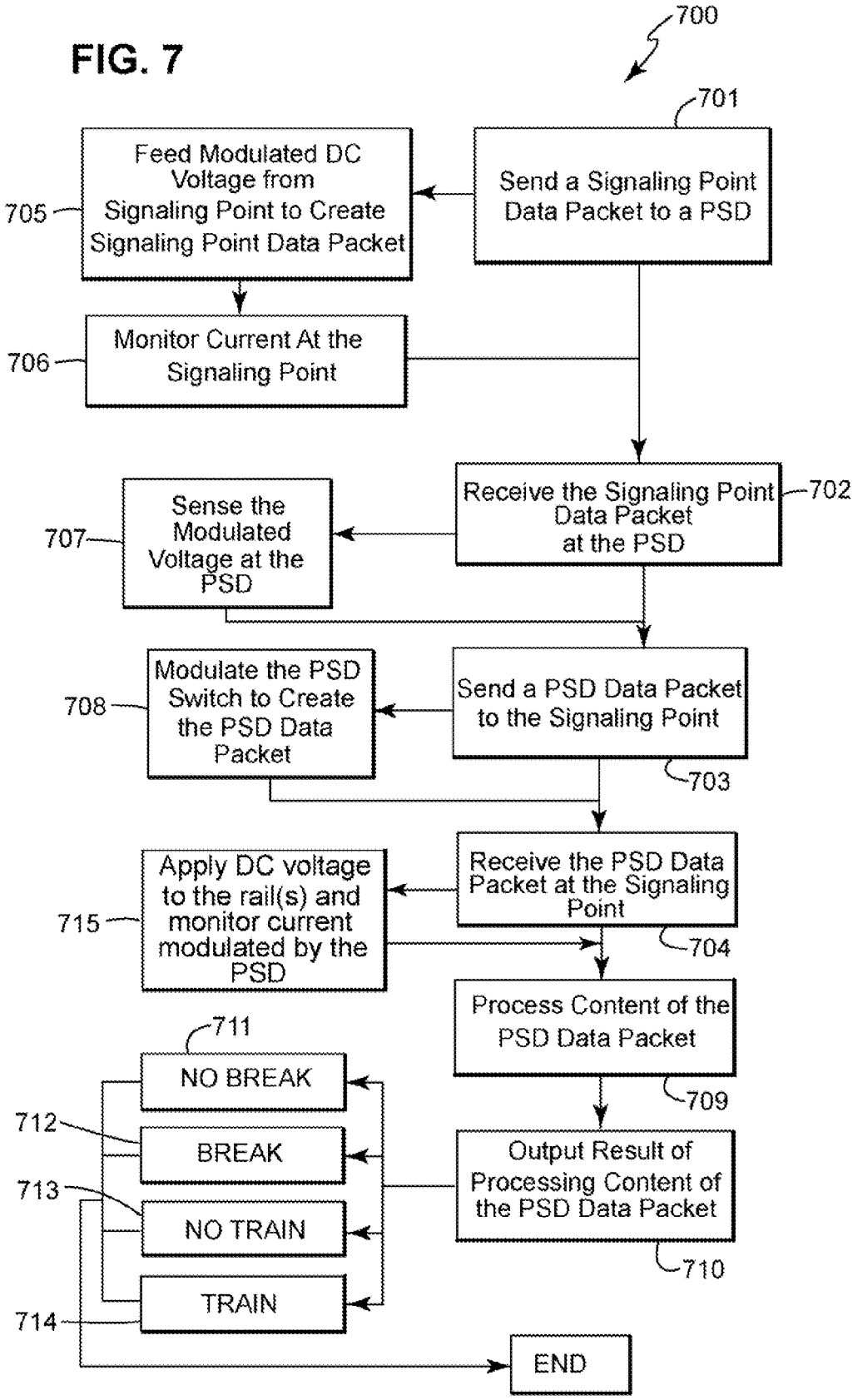
FIG. 7 is a flowchart of an exemplary method for communicating data to and from a signaling point.

FIG. 7 is a flowchart of an exemplary method 700 for communicating data to and from signaling points 212, 214 and PSD 205. Referring to FIGS. 6 and 7, the method 700 may begin at step 701 by sending a data packet from a signaling point 212 to a PSD 205. The step 701 may include steps 705 and 706. At step 705, modulated voltage applied to the track from the signaling point 212 creates the data packet. At step 706, the modulated current provided by the signaling point 212 is monitored at the PSD 205.

As the signaling point 212 sends the data packet to the PSD 205, the method 700 may further include a step 702 of receiving the data packet at the PSD 205. The step 702 may include step 707. At step 707, the PSD 205 receives the modulated current provided by the signaling point 212. Thereafter, the method 700 may include a step 703 of sending a data packet from the PSD 205 to the signaling point 214. The step 703 may include a step 708. At step 708, the PSD switch is modulated to create the data packet of step 703. Thereafter, the method 700 may include a step 704 of receiving the PSD data packet at the signaling point 214. Step 704 may further include a step 715 of applying a voltage to the rail and monitoring current modulated by the PSD 205. In an embodiment, the voltage may be a DC voltage applied by a signaling point 214.

At step 709, the content of the PSD data packet may be processed by a control device and/or compared with a data structure of the types shown in Tables 1 and 2 to determine one or more characteristics about a predetermined block of railroad track 202, 203, 204. At step 710, a result of processing the content of the data packet is outputted. The step 710 may include a step 711 of outputting a result of "NO BREAK," meaning that a block of railroad track 202, 203, 204 has no breaks. Alternatively, the step 710 may include a step 712 of outputting a result of "BREAK," meaning that a block of railroad track 202, 203, 204 has a break in one or both of its section of rails. The location (e.g., distance from a PSD 205 and/or a PSD 206) of the break within a block of railroad track 202, 203, 204 may also be specified.

The step 710 may further include a step 713 of outputting a result of "NO TRAIN," meaning that no train is present within a block of railroad track 202, 203, 204. Alternatively, the step 710 may further include a step 714 of outputting a result of "TRAIN," meaning that a train has been detected within a block of railroad track 202, 203, 204. The location of the train (e.g., distance of the train from a PSD 205 and/or a PSD 206) may also be specified. After all results have been outputted, the method 700 may end.

Attention is now directed to various embodiments of distances between PSDs and/or signaling points. Using PSDs between signaling points, the DC voltage from one signaling point does not have to reach to the next signaling point for the track circuit functions to work. This allows the distance between signaling points to be extended approximately 1.5×-2× further than the typical distance (e.g., @2.5 miles) that separates signaling points today. Consequently, using embodiments of the methods and system described herein, the distance between signaling points may be extended to about 5 miles. Increasing the DC driving voltage at the signaling points can extend this distance by about another 50%, to about 7 or 8 miles. The distance between PSDs is determined, inter alia, by the number of "blocks" desired between signaling points, and the resolution of the locations of rail breaks and trains within a "block."

Embodiments of the new jointless track circuit methods and system described herein are configured to co-exist with existing signaling systems. Consequently, signals to and from the PSDs are designed not to interfere with grade crossing and cab signals.

Additionally, the PSD-to-rail interface (e.g., track circuit systems 200, 400, and 600 in FIGS. 2, 4, and 6, respectively) is configured so as not to cause significant loading to the grade crossing and cab signaling systems. This may require adding a low-pass filter between the PSD connection and the rail(s).

Where AC signals are used to provide the jointless track circuit function, the circuits can be set up such that grade crossing frequencies are used to sense trains near the grade crossing, and such that other frequencies generated by the track circuit are used to detect trains away from the grade crossing. The track circuits are further configured so that they will not interfere with each other. For example, in one embodiment, spread spectrum signals are used to hide the jointless track circuit frequencies from the grade crossing equipment. Alternatively, each jointless track circuit (e.g., block of railroad track) is configured to operate at frequencies outside the shunt filters used for the grade crossing.

The components and arrangements of the methods and systems for jointless track circuits, shown and described herein are illustrative only. Although only a few embodiments have been described in detail, those skilled in the art who review this disclosure will readily appreciate that substitutions, modifications, changes and omissions may be made in the design, operating conditions and arrangement of the preferred and other exemplary embodiments without departing from the spirit of the embodiments as expressed in the appended claims. Accordingly, the scopes of the appended claims are intended to include all such substitutions, modifications, changes and omissions.

What is claimed is:

1. A jointless track system comprising:

a first signaling point connected to a railroad track;

a second signaling point connected to the railroad track, wherein a first distance between the first signaling point and the second signal point is at least five miles, wherein the railroad track is jointless along the entirety of the first distance and there are no signaling points between the first and second signaling points, and wherein at least one of the first signaling point and the second signaling point is configured to provide a voltage and/or current to the railroad track; and a first passive signaling device ("PSD") and a second PSD each attached to the railroad track and positioned between the first signaling point and the second signaling point, wherein a second distance between the first PSD and the second PSD is one or more miles, and wherein there are no passive signaling devices between the first PSD and the second PSD;

wherein each of the first PSD and the second PSD is configured to: receive electrical power from the voltage and/or current provided to the railroad track by the at least one of the first signaling point and the second signaling point, for powering the PSD; and to analyze the voltage and/or current for detecting a rail break and/or detecting presence of a train;

and wherein PSDs in the system are spaced apart from the first signaling point and the second signaling point by one or more miles.

2. The jointless track system of claim 1, wherein each of the first PSD and the second PSD comprises:

a current sensor coupled with the railroad track;

a PSD switch coupled with the railroad track; and a control device configured to operate the PSD, wherein the current sensor is also coupled with the control device.

3. The jointless track system of claim 2, wherein the PSD switch is a MOSFET.

4. The jointless track system of claim 2, wherein each PSD further comprises:

an analog to digital ("A/D") converter operated by the control device, wherein the A/D converter is configured to receive a positive voltage input from a first rail of the railroad track and is configured to receive a negative voltage input from a second rail of the railroad track.

5. The jointless track system of claim 4, wherein the A/D converter is further configured to receive a positive current input and a negative current input from the current sensor.

6. The jointless track system of claim 1, wherein each of the first signaling point and the second signaling point is configured to apply an AC voltage to the railroad track.

7. The jointless track system of claim 1, wherein each of the first PSD and the second PSD is configured to communicate track data to the first signaling point and/or to the second signaling point via the railroad track.

8. The jointless track system of claim 1, wherein each of the first PSD and the second PSD is configured to optimize an amplitude, modulation, coding, and frequency of waveforms to be applied to the railroad track for at least three track circuit functions: detecting a train on a block of the railroad track, detecting broken rails in the block of the railroad track, and communicating with a train cab on the block of the railroad track.

9. The jointless track system of claim 8, wherein the track circuit function of detecting trains uses DC signals to detect a presence of train on the block and AC signals to locate a position of the train on the block.

10. The jointless track system of claim 8, wherein the track circuit function of detecting breaks uses DC signals to detect breaks in the rails on the block and AC signals to locate the position of the breaks on the block.

11. The jointless track system of claim 8, wherein each of the first PSD and the second PSD is configured to communicate break detection and/or train detection data to the first signaling point and/or the second signaling point using orthogonal frequency divisional multiplexing and/or spread spectrum modulation.

12. The jointless track system of claim 8, wherein each of the first PSD and the second PSD is configured to perform the three track circuit functions in a predetermined duty cycle.

* * * * *